US007527260B2

(12) United States Patent
Moore

(10) Patent No.: US 7,527,260 B2
(45) Date of Patent: May 5, 2009

(54) CLOSED LOOP SCUFFER FOR SHEET HANDLING

(75) Inventor: Steven Robert Moore, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 284 days.

(21) Appl. No.: 11/784,644

(22) Filed: Apr. 9, 2007

(65) Prior Publication Data

US 2008/0246212 A1 Oct. 9, 2008

(51) Int. Cl.
*B65H 43/00* (2006.01)

(52) U.S. Cl. ..... 271/176; 271/220; 271/207

(58) Field of Classification Search ..... 271/207, 271/220, 176, 241
See application file for complete search history.

(56) References Cited

U.S. PATENT DOCUMENTS 5,120,046 A * 6/1992 Mandel et al. ..... 271/220
5,199,703 A * 4/1993 Hess ..... 271/314
5,284,338 A * 2/1994 Allmendinger et al. ..... 271/220
6,910,688 B2 * 6/2005 Saito et al. ..... 271/220
7,014,183 B2 * 3/2006 Tamura et al. ..... 270/58.09
7,182,333 B2 * 2/2007 Tamura et al. ..... 271/176
7,441,771 B2 * 10/2008 Tamura et al. ..... 271/207
7,451,980 B2 * 11/2008 Tamura et al. ..... 271/220
2008/0136090 A1 * 6/2008 Bober ..... 271/221

* cited by examiner

*Primary Examiner*—Kaitlin S Joerger
(74) *Attorney, Agent, or Firm*—James J. Ralabate

(57) ABSTRACT

This is a paper-handling system using a motor driven frictional drive element to push a paper sheet into a compiling tray. The tray has a registration wall where a paper sheet is abutted to align a paper stack. The system uses a sensor to convey relevant information to the motor and drive element as to the location of the top paper sheet vis-à-vis the registration wall. By instructing the motor and drive element on the top sheets location, better and more consistent paper-stacking alignment is accomplished.

18 Claims, 7 Drawing Sheets

CLOSED LOOP SCUFFER FOR SHEET HANDLING

This invention relates to media or paper moving marking systems and apparatus and, more specifically, to a feeder or finishing compiling structure both useful in said systems and apparatus.

BACKGROUND

Marking systems that transport paper or other media are well known in the art. These marking systems include electrostatic marking systems, non-electrostatic marking systems, printers or any other marking system where paper or other flexible media or receiving sheets are transported internally to an output device, such as a finisher and compiler. Many machines are used for collecting or gathering printed sheets so that they may be formed into books, pamphlets, forms, sales literature, instruction books and manuals and the like.

The finisher and compiler are located at a site in these marking systems after the receiving sheets (paper) have been marked. A finisher is generally defined as an output device that has various post printer functions or options such as hole punching, corner stapling, edge stapling, sheet and set stacking, letter or tri-folding, Z-Folding, Bi-folding, signature booklet making, set binding (including thermal, tape and perfect binding), trimming, post process sheet insertion, saddle stitching and others.

The compiler often employs a compiling wall or tray where frictional drive elements hereinafter called elastomer paddle wheels or "paddle wheels" (PW) or scuffers are used to drive sheets (paper) against the compiling wall for registration of the staple or bind edge of a set. If desirable, belts or scuffer wheels may be used, etc. instead of paddle wheels. The force of these frictional drive elements on the sheet is critical and, must be controlled within narrow limits. In the case of Deflection Loaded technologies, such as Paddle Wheels, the compiler element drive force has been found to be dependent on many factors including the type or thickness of the paper used. In many such finisher compiling systems, the compiler drive element is periodically indexed or adjusted to attempt to compensate for stack misalignment or build up. Sheet counting is frequently used as a criteria to index the Compiler Drive element shaft, but it does not successfully comprehend curl build up or variations in paper weight/thickness.

The compiling capacity and bind edge sheet registration can be compromised with moderate to severe misalignment of the sheets. Excessive misalignment can cause poor set registration and possibly paper jams or sheet damage.

As discussed above in [003], finisher compiling systems often employ frictional drive elements such as foam scuffer wheels or elastometric paddle wheels to drive the individual sheets square (deskewed) and against the registration edge. With such compliant drive elements, the normal force on the paper and, thus, the drive force, will differ as the paper weight or thickness changes.

What can occur is that if there is too little drive force, the sheets will not be properly registered or deskewed. Too much drive force and the top sheets will buckle causing poor set registration and possibly sheet damage or a jam or limiting set size (thickness) compiled.

As noted, differences in media weight and curl will have significant, if not, dramatic effects on the net available drive force and thus upon the final sheet alignment condition. Additionally, any drag forces acting on the sheet may further reduce the net drive force and thus affect sheet alignment.

A rapid increase in on-demand service to provide large-volume small-scale printing of brochures, etc. by use of color/black and white multifunction machines has been exhibited. Even ordinary offices are stepping up their efforts at in-house production of conference paper, simple booklets, manuals and other materials by establishing service departments for intensively processing prints in large quantities. Such customers require post-processing functions, such as high-speed/high-precision punching, stapling and paper folding work with simultaneous print output and realization of high-speed/high-quality print output with a high degree of reliability.

"Drive elements or frictional drive elements" as used in this disclosure and claims include any suitable drive element. Also, any number of scuffers or paddle wheels usually elastomer and any suitable number of sensors may be used. The size, type, and number of paddle wheels and blade depend upon many variations in the paper used, such as size of paper, weight of paper, coated or non-coated paper, paper for color prints, paper for monochrome prints, etc. and the specific compiler tray geometry. Also, curl suppressors can be desirably used together with the paddle wheels to improve paper registration. The desired or ideal drive force of the paddle wheels will, of course, vary as the conditions, paper and paper size and other variables change or exist; this ideal drive force can be easily established through simple tests and then fixed in the controller used.

In many finisher compilers, a scuffer mechanism is employed to frictionally drive sheets up to a fixed registration wall. Sheet lead edges are aligned both along the process direction, as well as deskewed as they are forced into contact with the wall. As an example, a High Capability Stacker utilizes three scuffer belts that are intermittently driven so as to draw each incoming sheet across the stack and against the registration wall. The frictional drive elements or scuffer imparts a drive force to the top of each sheet through a predetermined normal force and a controlled friction coefficient. There is a very significant tradeoff involved in determining the optimum drive force. A large heavyweight sheet may offer a high resistance to motion and thus may slip within the scuffer. The scuffer must remain driving for sufficient time so that the sheet ends up properly registered. By contrast, a small lightweight sheet may offer little resistance to motion and have no slip. This sheet will reach the registration wall much sooner and will then be forced to slip and/or buckle until the scuffer is turned off. It would be advantageous if a schedule of different scuffer motion profiles were available for different media types, but drag force variations due to electrostatic forces, curl, etc. make this impractical.

SUMMARY

The embodiments of this invention describe the addition of a simple sensor to a scuffer mechanism. The sensor is capable of tracking motion of a paper or media sheet across the top of a stack. Specifically, the sensor measures the motion of the topmost sheet of a paper stack that is under control of a drive mechanism. The drive mechanism could be a compiler scuffer mechanism, a feeder nudger mechanism, paddle wheels or any similar device imparting motion to the top sheet of a stack. The sensor consists of a rotatable wheel to which an encoder is attached. The wheel is biased with a small normal force onto the stack. The circumference of the wheel has a material with high coefficient of friction to paper. If the top sheet of the stack is moving, then the wheel will rotate and the encoder produces an output signal. If the top sheet is not moving, the encoder produces no output signal. Placement of the sensor at a suitable position in the system will provide signals to allow closed loop operation of the scuffer mechanism and more optimal sheet handling.

The sensor wheel in an embodiment is coupled to a suitable sensor (mechanical, electrical or can be optical or proximity type) that measures how far from the compiling wall the top sheet has stopped or how far beyond the wall the sheet has been overdriven. It then can convey this information to a controller (usually software), the controller then conveys this information to the scuffer motor. The motor then moves the sheet of paper via the scuffer a distance calculated to drive the sheet leading edge against the retaining wall until the top sheet is in perfect alignment with the paper stack. The sheets in the stack are now all in alignment.

The controller is pre-programmed with the number of sensor encoder pulses required for the scuffer to move a sheet against the retainer wall once the sheet leading edge has arrived at the sensor. Therefore the controller can cause the move of a sheet forward if it is short of the retainer wall, irrespective of any slip that may occur between the scuffer and the top sheet. Also, the controller can cause the move of a sheet backward if the sheet is beyond (buckled) the retainer wall. Embodiments of the present invention and this sensor-scuffer system offer increased latitude and a more robust solution to compensating for media known and unknown variables in the operation of the compiler drive element system.

While embodiments of this invention will be described herein for clarity in reference to a finisher compiler, the invention can apply equally as well to paper feeder mechanisms. For many feeder mechanisms, a drive element analogous to a scuffer is used to drive a top sheet off of a stack. The described sensor can be employed to measure the top sheet's motion accordingly. Typically, the drive mechanism is required to drive the top sheet a known distance to reach a sheet separation device. The sensor output is used to assure that the top sheet progresses the required distance.

The present invention and this control scheme offers increased latitude and a more robust solution to compensating for unknown variables in the operation of the compiler drive element indexing system.

The sensor used in the present embodiments indicates how much the sensor wheel rotates as top sheet or paper moves against it and travels toward registration wall and indicates the position of the sheet from the wall; i.e. not far enough or too far. The encoder is a device to measure rotational displacement of an item, in this case, the sensor wheel.

The present invention basically aligns sheets in a compiling tray by monitoring top sheet motion while subjected to the scuffer force. The embodiments of this invention control scuffer force or motion to deal with light weight and heavy paper or media sheets. Usually various types of paper present different compiling conditions that need correction; for example, in heavy or thick sheets fed, the required scuffer drive force is very high, and the paper will slip and not reach the registration wall.

Thin or lighter weight sheets could hit the wall much sooner than heavy weight sheets and may buckle against the wall and jam.

The sensor senses the location of the top sheet only and then activates the motor accordingly, via the controller. If the top sheet has not reached the retaining wall, the control will activate the motor forward. If the top sheet is sensed to be beyond the retaining wall a minimum distance determined to force alignment of the sheet leading edge against the wall (deskewing) the motor will be stopped.

DETAILED DESCRIPTION OF DRAWINGS AND PREFERRED EMBODIMENTS

Figure 1:
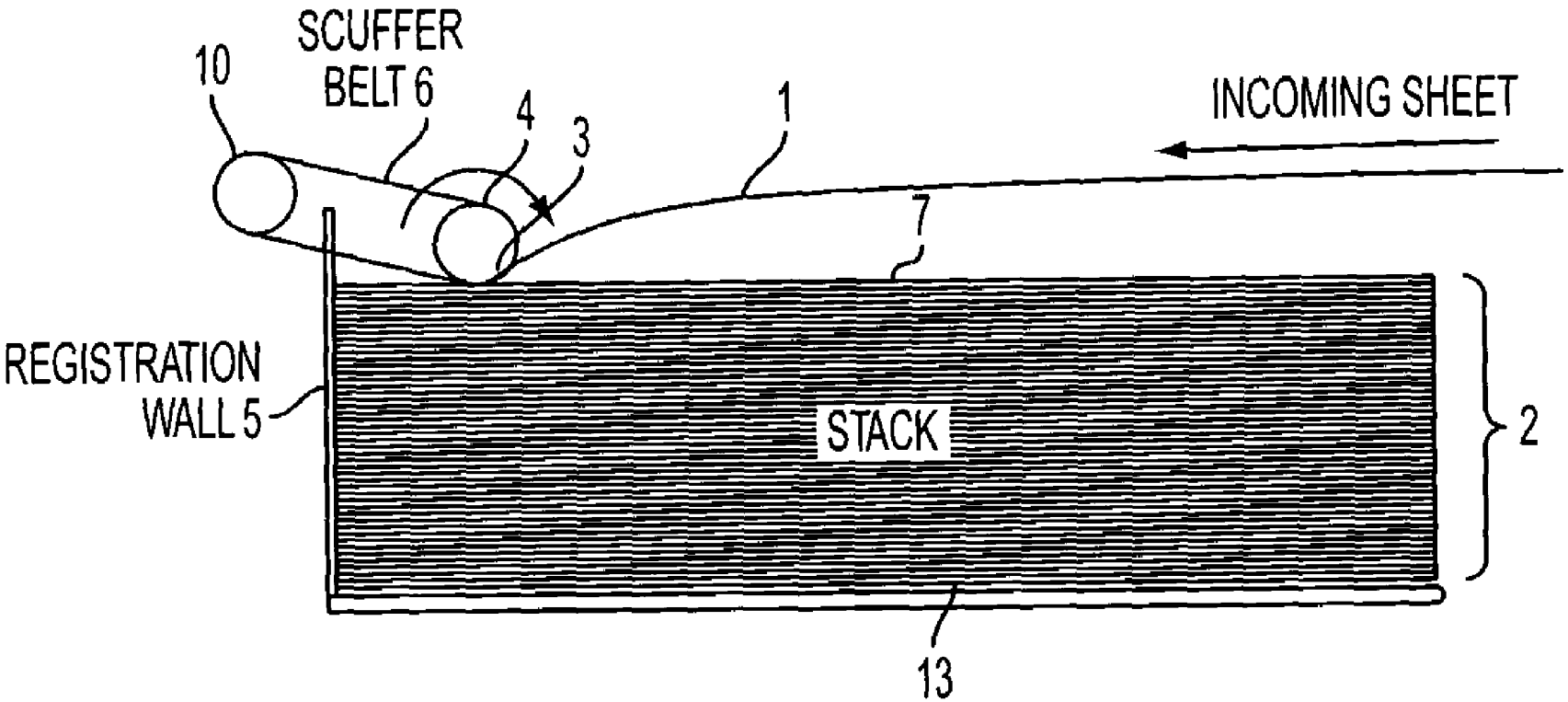
FIG. 1 illustrates a typical compiler station with a compiler tray and compiler wall or registration guide.

FIG. 1 shows a typical example where sheets 1 are being deposited onto the top of a stack 2. Each sheet 1 is transported partially across the stack 2 and then its lead edge 3 reaches a scuffer mechanism 4. The purpose of the scuffer mechanism 4 is to finish the sheet transport across the stack 2 and to drive the sheet lead edge 3 against a registration wall 5 so the sheet 1 is aligned with the stack. The mechanism shown is similar to that used on a known High Capacity Stacker. In this case, it consists of a series of independent belts 6 arrayed along the cross-process direction of the paper path. The belts 6 can be driven by a motor, not shown. The belt periphery rests on top of the stack 7 and the normal force is controlled by gravity and any acceleration torque. The belts 7 have a higher friction coefficient to paper than the sheet-to-sheet friction coefficient. In practice, rotation of the belts 7 causes the topmost sheet to develop a drive force toward the registration wall 5. When a sheet lead edge 3 has reached and aligned to the wall 5 further belt travel will either result in slip against the top sheet 1 or buckling of the top sheet.

Figure 2:
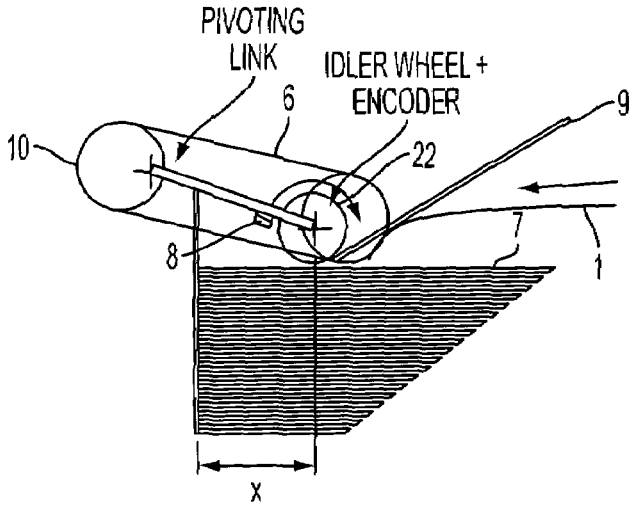
FIG. 2 illustrates an embodiment of this invention with a sensor in conjunction with the scuffer mechanism.

In the embodiment of FIG. 2 a sensor 8 is inserted within the scuffer mechanism that is driven by wheel 10. The sensor 8 consists of a wheel 22 to which a rotary encoder is attached or otherwise integrated. The wheel 22 rests upon the top of the stack 7 with a controlled low normal force. Whenever the topmost sheet 1 below the wheel 22 is being advanced by the scuffer, then the wheel will turn due to sheet motion at contact point 9 and the encoder will emit output pulses to a controller. Both the quantity and rate of pulses will be proportional to the sheet displacement and velocity, respectively. When the topmost sheet is stationary, the wheel 22 is also stationary and no pulses are emitted.

FIG. 2 illustrates an example of the proposed sensor 8 used in conjunction with the belt scuffer mechanism. The wheel 22 is placed out of plane with the individual belts 6. The wheel is placed downstream of the nominal scuffer contact point on the stack. The sensor wheel nominal contact point 9 is located X mm from the registration wall. Thus, once a sheet's lead edge 1 has just entered point 9, it can be expected that the sheet 1 must nominally advance c X encoder counts before contacting the wall 5 where c=encoder counts/mm.

The proposed sensor 8 permits the scuffer operation to become closed loop via at least two control techniques. In one approach, the total travel distance of the scuffer 4 is controlled based upon the measured sheet travel. In another approach, the available drive force of the scuffer 4 is controlled based upon the measured sheet travel.

In the first approach, the motor controller operates in a closed loop fashion such that each sheet 1 is advanced through a fixed distance (X) rather than simply advanced for a fixed time interval. Thus, for example, a large heavyweight sheet with significant electrostatic drag may have substantial slip against the scuffer belts 6. Since the sensor wheel 22 is driven by the top surface of the sheet, it will track the actual sheet motion. Until the predetermined number of encoder pulses has been recorded, the scuffer drive motor can be left on. This predetermined count will be c X+d, where d=overtravel to compensate for tolerances and sheet skew. This control algorithm increases the likelihood that each sheet will be fully advanced to the registration wall. One limitation could be potential overtravel of lightweight sheets which may result in sheet buckle between the scuffer contact point and the registration wall 5 depending on the specific geometry. If a lightweight sheet is fully advanced to the wall and the scuffer cycles on prior to the next sheet arriving at the scuffer point, the first sheet may be "over-scuffed."

One potential solution to lightweight overscuffing could be to nominally park each sheet a distance (c x+d−A) mm away from the registration wall, where A is the nominal additional scuffing travel each sheet sees as the next sheet is entering but has not yet reached the scuffing point. Another control means that can prevent lightweight to overscuffing is to provide a means for variable scuffer drive force.

Figure 3A:
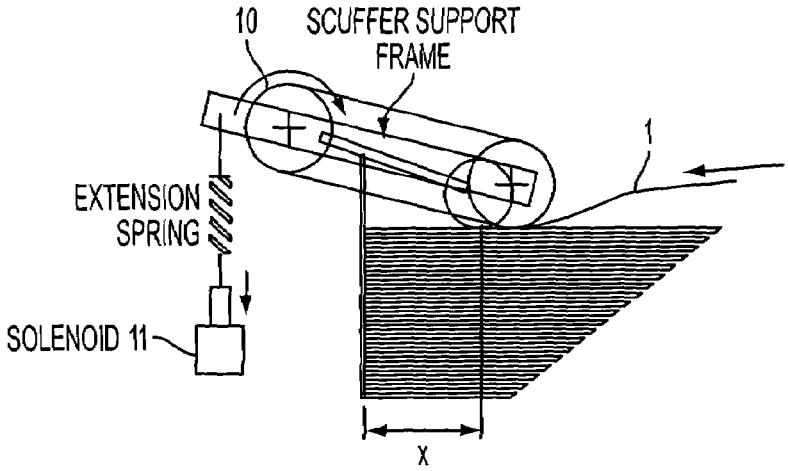
FIG. 3A illustrates another embodiment of this invention using an actuator such as a solenoid.
Figure 3B:
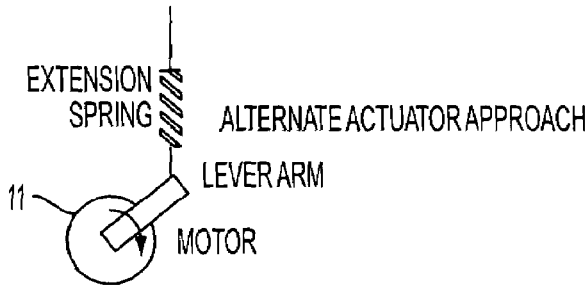
FIG. 3B illustrates a further embodiment using a motor to adjust scuffer normal force.

FIGS. 3A and 3B show one simple means by which the scuffer normal force, and hence drive force, can be modulated by an actuator such as a solenoid or motor 11. There are different control algorithms that could utilize the sheet travel sensor and the drive force actuator. As an example, the scuffer normal force could be set at the lowest possible setting for each sheet. If the sheet has not advanced a sufficient distance with a prescribed time interval, the normal force is increased and scuffing continues. When total distance c X+d has been achieved, scuffer normal force is reset to its low level to avoid generating buckle.

Figure 4:
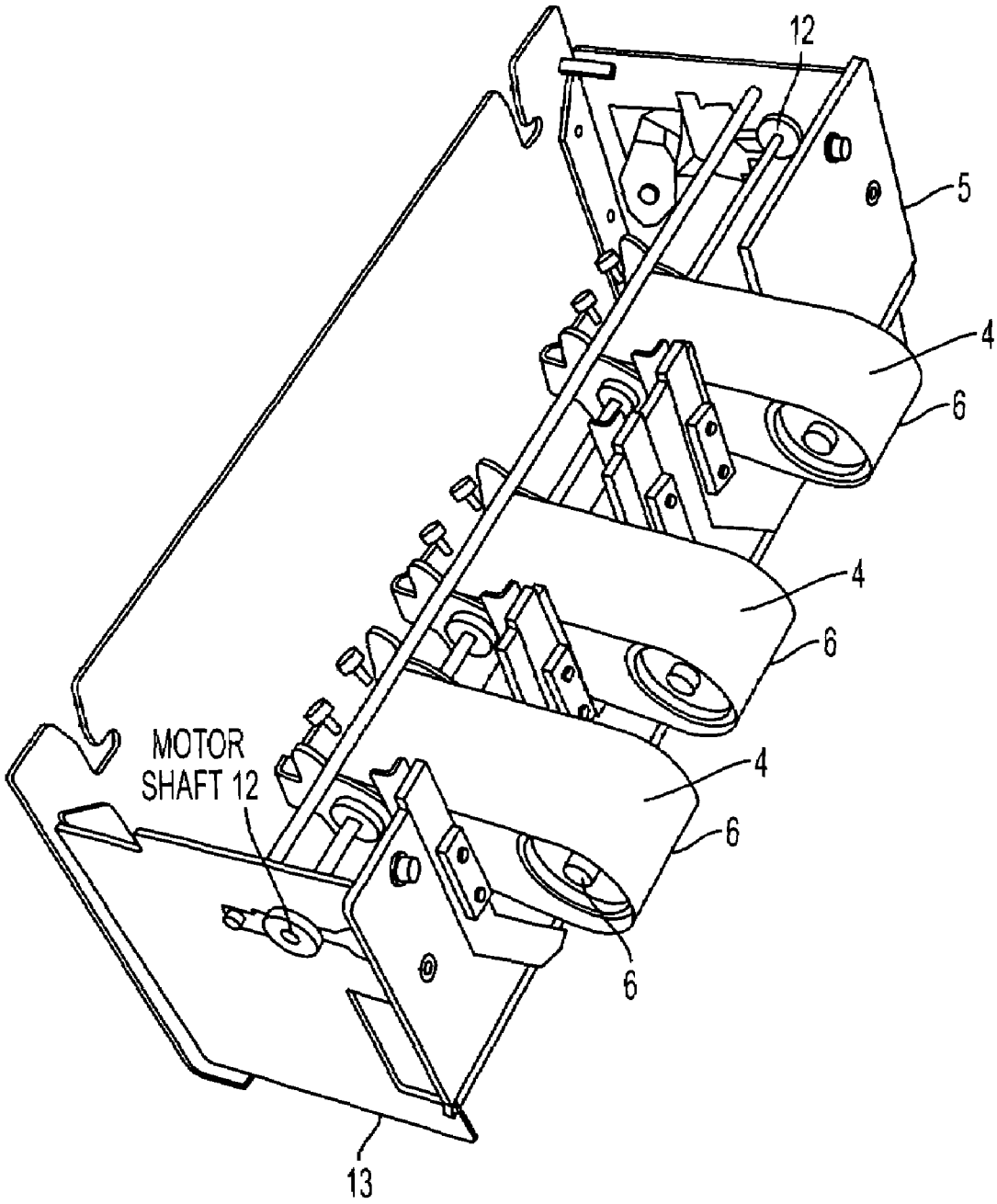
FIG. 4 illustrates a perspective view of a compiler element of this disclosure.
Figure 7:
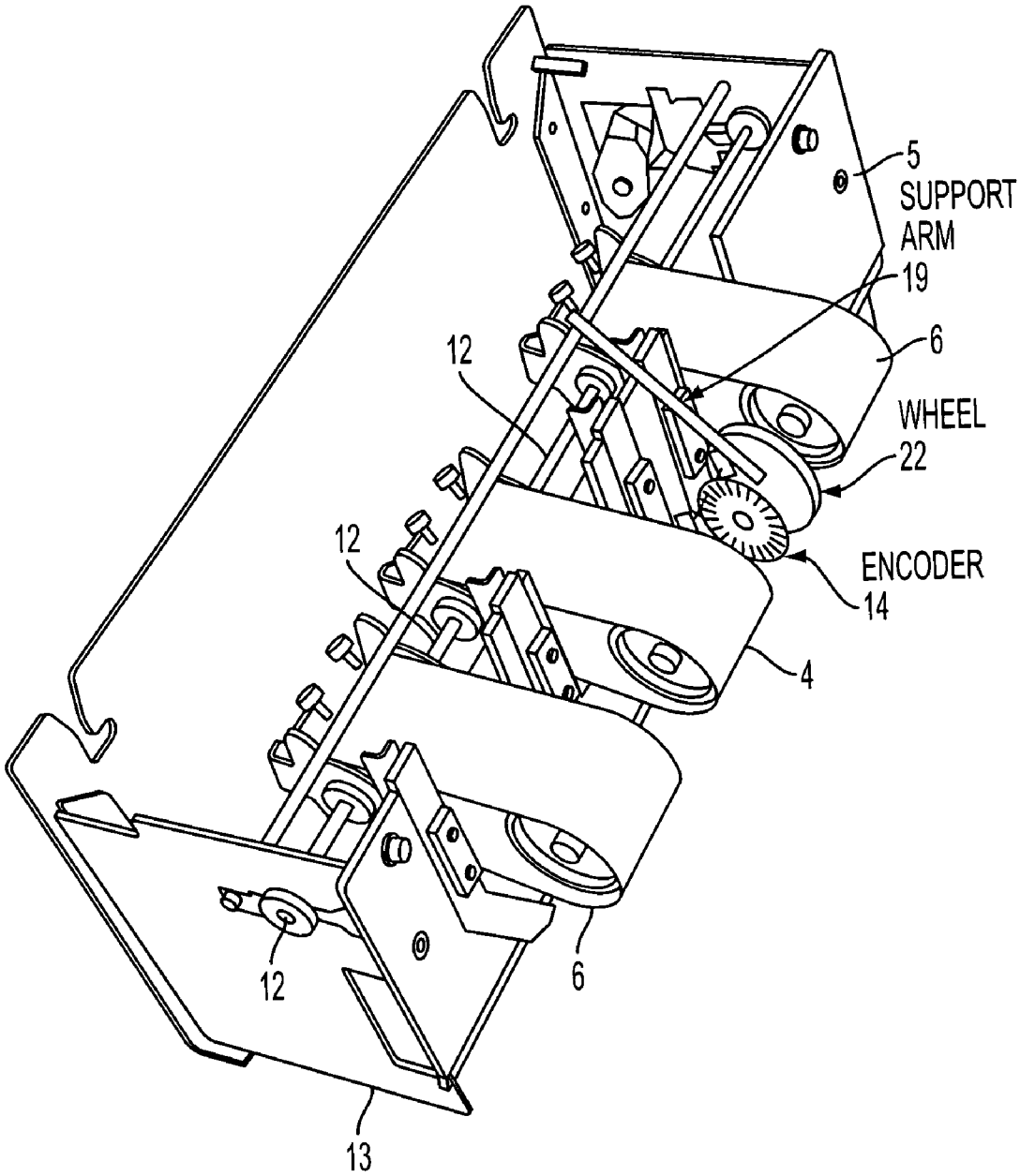
FIG. 7 shows an embodiment with the encoder position within the present structure.

FIG. 4 is a perspective view of an existing compiler element. In FIG. 7 a perspective view of an embodiment of the compiling station of this invention is shown. The scuffer rolls 4 are powered or rotated by scuffer belts 6. The belts 6 contact the top sheet 1 of the paper stack 2. The belts 6 are connected to driver wheels 10 that are rotated along a motor shaft 12. The sensor 8 (and controller) are operationally connected to the motor shaft 12 and motor 11 (not shown). A registration wall 5 is positioned behind these components and is enabled to receive paper sheets that pass under and are moved by scuffer belts 6 and rolls 4. The sheets 1 stack up against and are aligned by registration wall 5. If sheets stop short of wall 5, the sensor conveys this to the controller, and the controller instructs the motor to push the stalled sheet 1 to the retaining wall 5 so it is in alignment with the other sheets in the compiler tray.

Figure 5A:
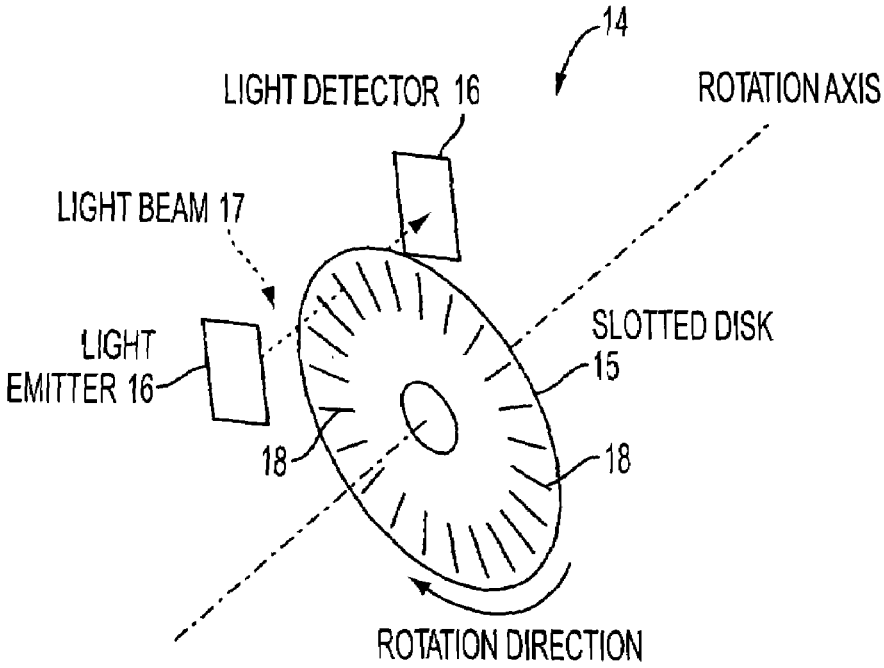
FIG. 5A a perspective view of an encoder that can be used in the present invention.
Figure 5B:
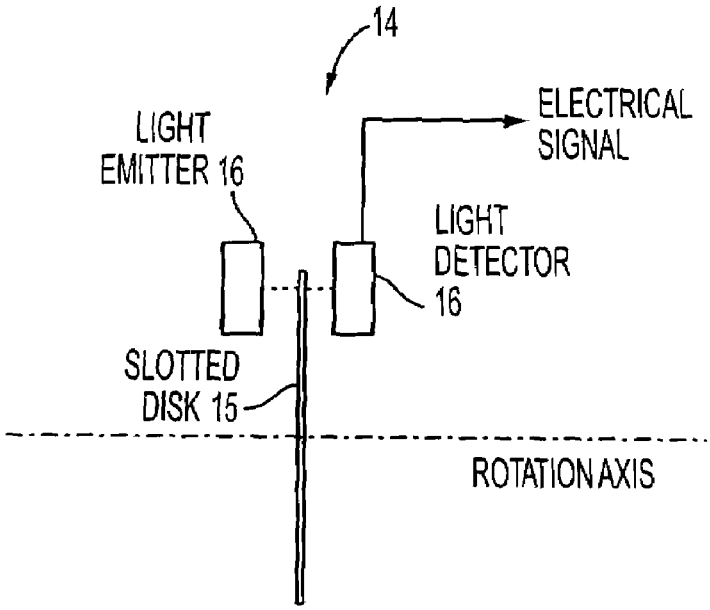
FIG. 5B is a side view of the encoder of FIG. 5A.

As shown in FIGS. 5A and 5B, a rotary optical encoder 14 is commonly used to measure the rotational displacement of a shaft 12. It consists of a slotted disk 15 mounted to the shaft 12 and an optical emitter detector pair 16 mounted to a stationary surface. FIG. 5A is a top perspective view and FIG. 5B is a side plan view of the encoder 14 (as shown in position in FIG. 7). The disk 15 is commonly fabricated from glass, metal, or plastic and contains a series of radially oriented apertures 18 adjacent to its outside edge. The emitter/detector pair 16 is located so that a light beam 17 originating at the emitter is intersected by the disk 15. Whenever a disk aperture 18 rotates past the light beam 17, the detector 16 records a signal. By these means the rotational displacement of the shaft is encoded as a series of signals by the detector. For this invention the optical encoder is shown as an exemplary encoder. Other encoder types, such as those using electromagnetic field sensors are equally applicable.

Figure 6:
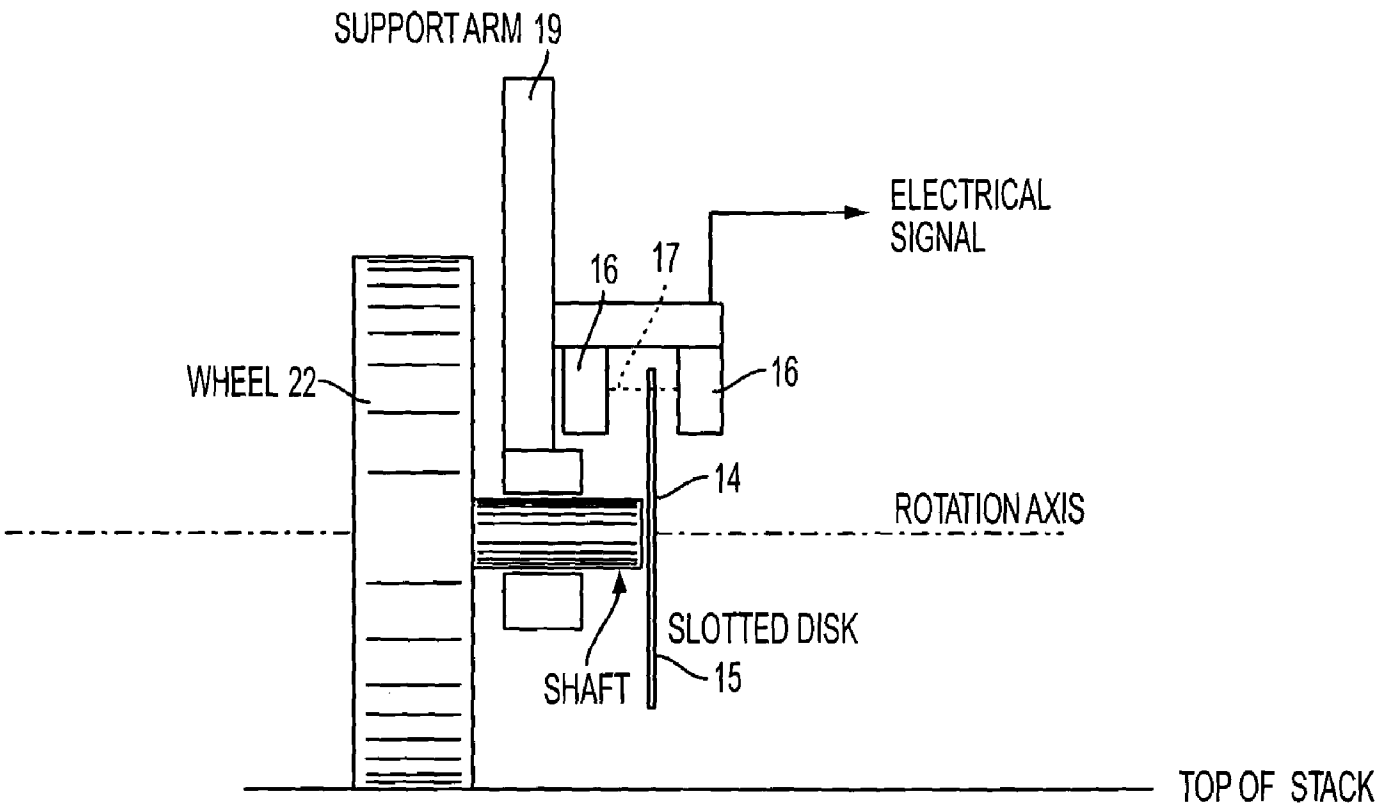
FIG. 6 is a sensor assembly that can be used in the present invention.

In FIG. 6 the encoder 14 is attached to a shaft 12 in common with a wheel 22. The wheel 22 has a surface selected to maintain a high coefficient of friction with sheets 1. A support arm structure serves to locate the wheel on top of a stack of sheets, to provide a suitable bearing surface to the shaft, and to locate the emitter/detector pair 16. Thus, as a sheet 1 moves on top of the stack, it causes the wheel 22 to rotate, which in turn causes the disk 14 to rotate and the detector to encode the shaft rotational displacement.

Figure 8:
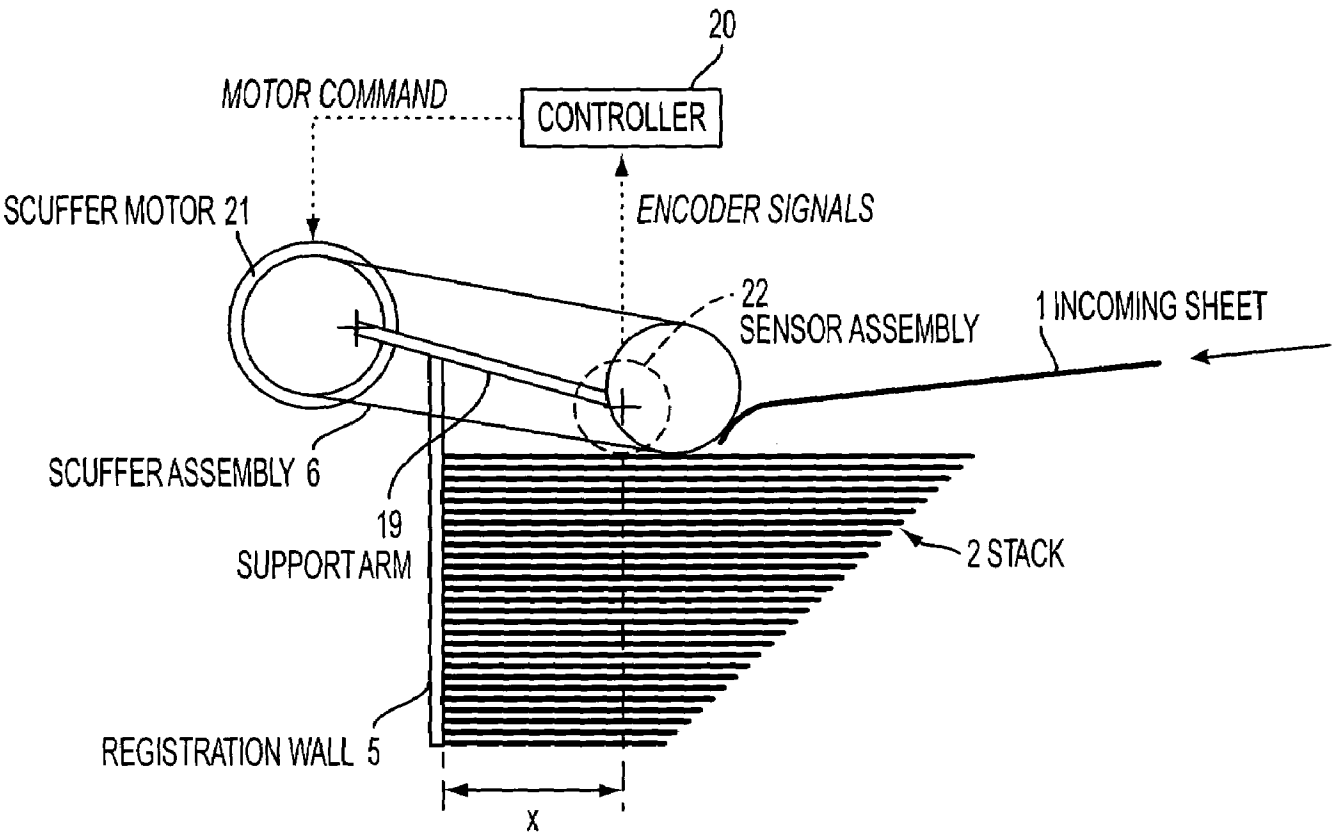
FIG. 8 is a diagram illustrating the component elements of an embodiment.

In FIGS. 7 and 8 when the incoming sheet 1 reaches the scuffer roll 4, the controller 20 turns on the scuffer motor 21 and the scuffer rolls 4 or belts 6 begin to drive the sheet 1 in a forward direction. As the leading edge 3 of the sheet passes under the sensor assembly 8, the sensor wheel 22 begins to be driven by the sheet, and the encoder 14 begins to send signals to the controller 20. In one instance, the controller 20 keeps the motor 21 on until sufficient signals are received from the encoder 14 that a sheet travel distance "x" has been achieved. The controller 20 is then assured that the sheet 1 has reached the registration wall 5 and can stop the scuffer motor after a limited amount of additional travel to assure that sheet 1 has been fully aligned against the registration wall 5. The support arm 18 holds the encoder assembly 14 in place and prevents its movement. Any suitable number of scuffer belts 6 or scuffer rolls 4 may be used. The motor 21 (not shown) is attached operatively to motor shaft 12.

In summary, the present embodiment provides a structure useful in a paper-handling system which comprises in an operative arrangement at least one drive shaft, at least one frictional sheet drive element in contact with the shaft, a tray adapted to house a stack of the sheets, a reference surface associated with the tray, at least one drive shaft speed controller(s) and at least one rotational sensor. The sensor is driven by a top sheet of the stack to determine the sheet's distance from the reference surface. The sensor is enabled to convey this distance information to the controller. The controller is enabled to instruct the drive shaft as to its speed required to position the sheet in relationship to the reference surface. The reference surface is a registration wall and the controller(s) and sensor(s) are enabled to sense the top sheet's travel and will control the travel so that a sufficient force is exerted upon said top sheet in the tray against said registration wall to maintain each sheet in alignment. The sensor(s) is located adjacent to the sheet drive element. The said structure is enabled to advance the top sheet toward the reference surface for a predetermined sheet travel distance rather than a predetermined time interval.

In an embodiment the sensor comprises a rotary encoder attached to a wheel which is driven by a top surface of said sheet and will be enabled to track an actual sheet motion of said sheet toward said reference surface. A control algorithm in said controller enables each sheet to be fully advanced to said reference surface. The reference surface comprises a sheet separation device used in conjunction with a sheet feeder.

The present embodiments provide a method of controlling motion of a top sheet of a stack of sheets in a tray which comprises rotating a drive shaft and rotating at least one frictional sheet drive element in operative contact with the shaft to provide a net drive force on the top sheet of said stack to cause said top sheet to move. Then a sensor measures the travel of the top sheet with a sensor in operational contact with the top sheet, and using the sensor signal to determine the distance between the top sheet and a reference surface associated with said tray. Subsequently a sensor conveys this distance information to a controller and controls the speed of the sheet drive element using the measured travel of the top sheet, driving the top sheet to a fixed relationship with the reference surface. The reference surface is a registration wall. The controller(s) and the sensor(s) sense the top sheet's travel and control the travel so that a sufficient force is exerted upon the top sheet in the tray against the registration wall to maintain each sheet in alignment. The sensor(s) starts measuring the top sheet's travel when the sheet drive element starts to rotate.

As above noted, the top sheet is advanced toward the reference surface based upon its measured distance from the reference surface rather than upon a predetermined time interval. The sensor is rotated by a top surface of the top sheet and the sensor emits a series of pulses proportional to actual sheet motion of the sheet toward the reference surface. A control algorithm in the controller monitors the sensor's output signals and regulates the speed of the sheet drive element to move the top sheet into a fixed relationship with the reference surface. In this embodiment, sensor(s) output signals are generated using a rotary encoder attached to a wheel.

It will be appreciated that variations of the above-disclosed and other features and functions, or alternatives thereof, may be desirably combined into many other different systems or applications. Also, that various presently unforeseen or unanticipated alternatives, modifications, variations or improvements therein may be subsequently made by those skilled in the art which are also intended to be encompassed by the following claims.

What is claimed is:

1. A structure useful in a paper-handling system which comprises in an operative arrangement at least one drive shaft, at least one frictional sheet drive element in contact with said shaft, a tray adapted to house a stack of said sheets, a reference surface associated with said tray, at least one drive shaft speed controller(s) and at least one rotational sensor, said sensor driven by a top sheet of said stack to determine said sheet's distance from said reference surface, said sensor enabled to convey this distance information to said controller, said controller enabled to instruct said drive shaft as to its speed required to position said sheet in relationship to said reference surface.

2. The structure of claim 1 wherein said reference surface is a registration wall and said controller(s) and said sensor(s) are enabled to sense said top sheet's travel and controlling said travel so that a sufficient force is exerted upon said top sheet in said tray against said registration wall to maintain each sheet in alignment.

3. The structure of claim 1 wherein said sensor(s) is located adjacent to said sheet drive element.

4. The structure of claim 1 wherein said structure is enabled to advance said top sheet toward said reference surface for a predetermined sheet travel distance rather than a predetermined time interval.

5. The structure of claim 1 wherein said sensor comprises a rotary encoder attached to a wheel which is driven by a top surface of said sheet and will be enabled to track an actual sheet motion of said sheet toward said reference surface.

6. The structure of claim 1 where a control algorithm in said controller enables each sheet to be fully advanced to said reference surface.

7. The structure of claim 1 wherein said reference surface comprises a sheet separation device used in conjunction with a sheet feeder.

8. A structure useful in a paper-handling system in an electrostatic marking system which comprises in an operative arrangement at least one drive shaft, at least one frictional sheet drive element in contact with said shaft, a tray adapted to house a stack of said sheets, a reference surface associated with said tray, and a sensor in operational contact with a top sheet of said stack, at least one drive shaft speed controller(s), said sensor enabled to determine said top sheet's distance from said reference surface, said sensor enabled to convey this distance information to said controller, said controller enabled to instruct said drive shaft as to its speed required to position said sheet in relationship to said reference surface, said sensor enabled to measure top sheet displacement when said top sheet moves and said sensor will emit output pulses to said controller, and wherein a quantity and rate of pulses is proportional to said sheets displacement and velocity.

9. The structure of claim 8 wherein said reference surface is a registration wall and said controller(s) and said sensor(s) are enabled to sense said top sheet's travel and controlling said travel so that a sufficient force is exerted upon said top sheet in said tray against said registration wall to maintain each sheet in alignment.

10. The structure of claim 8 wherein said sensor(s) is located adjacent to said sheet drive element.

11. The structure of claim 8 wherein said structure is enabled to advance said top sheet toward said reference surface for a predetermined sheet travel distance rather than a predetermined time interval.

12. A method of controlling motion of a top sheet of a stack of sheets in a tray which comprises rotating a drive shaft, rotating at least one frictional sheet drive element in operative contact with said shaft to provide a net drive force on the top sheet of said stack to cause said top sheet to move, measuring the travel of said top sheet with a sensor in operational contact with said top sheet, using said sensor signal to determine the distance between said top sheet and a reference surface associated with said tray, conveying this distance information to a controller, controlling the speed of said sheet drive element using the measured travel of the top sheet, so as to drive said top sheet to a fixed relationship with said reference surface.

13. The method of claim 12 wherein said reference surface is a registration wall said controller(s) and said sensor(s) sense said top sheet's travel and control said travel so that a sufficient force is exerted upon said top sheet in said tray against said registration wall to maintain each sheet in alignment.

14. The method of claim 12 wherein said sensor(s) starts measuring said top sheet's travel when said sheet drive element starts to rotate.

15. The method of claim 12 wherein said top sheet is advanced toward said reference surface based upon its measured distance from said reference surface rather than upon a predetermined time interval.

16. The method of claim 12 wherein said sensor is rotated by a top surface of said top sheet and said sensor emits a series of pulses proportional to actual sheet motion of said sheet toward said reference surface.

17. The method of claim 12 where a control algorithm in said controller monitors the said sensor's output signals and regulates the speed of said sheet drive element to move said top sheet into a fixed relationship with said reference surface.

18. The method of claim 12 wherein said sensor(s) output signals are generated using a rotary encoder attached to a wheel.

* * * * *